US007787232B2

(12) United States Patent
Abatemarco

(10) Patent No.: US 7,787,232 B2
(45) Date of Patent: Aug. 31, 2010

(54) MULTIFUNCTION SECURITY DEVICE

(75) Inventor: Michael R Abatemarco, 10559 N. 119th Pl., Scottsdale, AZ (US) 85259

(73) Assignee: Michael R Abatemarco, Scottsdale, AZ (US)

( * ) Notice: Subject to any disclaimer, the term of this patent is extended or adjusted under 35 U.S.C. 154(b) by 302 days.

(21) Appl. No.: 12/027,445

(22) Filed: Feb. 7, 2008

(65) Prior Publication Data

US 2009/0201621 A1 Aug. 13, 2009

(51) Int. Cl.
*F41C 9/00* (2006.01)

(52) U.S. Cl. ..... 361/232; 42/1.08

(58) Field of Classification Search ..... 361/232; 42/1.08; 102/502
See application file for complete search history.

(56) References Cited

U.S. PATENT DOCUMENTS

| | | | |
|---|---|---|---|
| 4,842,277 | A | 6/1989 | LaCroix |
| 4,843,336 | A | 6/1989 | Kuo |
| 5,086,377 | A | 2/1992 | Roberts |
| 5,108,098 | A | 4/1992 | Ashihara |
| 5,405,134 | A | 4/1995 | Wolfram |
| 5,517,180 | A | 5/1996 | Masi et al. |
| 5,529,215 | A | 6/1996 | Banks et al. |
| 5,556,003 | A | 9/1996 | Johnson et al. |
| D401,374 | S | 11/1998 | Lum |
| 5,893,483 | A | 4/1999 | Duran |
| 6,139,165 | A | 10/2000 | Crowe |
| 6,386,726 | B1 | 5/2002 | Macierowski et al. |
| 6,499,855 | B1 | 12/2002 | Kukuk |
| 6,615,622 | B2 | 9/2003 | MacAleese et al. |
| 7,004,597 | B2 | 2/2006 | Kukuk |
| 7,152,990 | B2 | 12/2006 | Kukuk |
| 7,524,076 | B2 * | 4/2009 | Kukuk ..... 362/112 |
| 2002/0108966 | A1 | 8/2002 | Park |
| 2002/0162852 | A1 | 11/2002 | Cellini et al. |
| 2002/0163799 | A1 | 11/2002 | Kukuk |
| 2007/0063848 | A1 | 3/2007 | Weisman |
| 2007/0238532 | A1 * | 10/2007 | Stethem ..... 463/47.2 |
| 2009/0020002 | A1 * | 1/2009 | Williams et al. ..... 89/41.03 |

OTHER PUBLICATIONS

ISR and Written Opinion for PCT/US2009/033083, dated Mar. 19, 2009.

* cited by examiner

*Primary Examiner*—Danny Nguyen
(74) *Attorney, Agent, or Firm*—Snell & Wilmer L.L.P.

(57) ABSTRACT

The present invention is directed to an apparatus for providing law enforcement and private citizens with a single device that integrates law enforcement tools and mechanisms for the application of force. An exemplary device features a metal detector, a light emitting source optionally having a strobe feature, an electric stun system, and a debilitating spray dispensing system. Some embodiments of the present invention include an electric stun system comprising a plurality of probes mounted to the distal terminus of the shaft and configured to protrude from the shaft, a plurality of plates configured longitudinally along the outer surface of the shaft, and a stun system switch disposed on the shaft. Some embodiments of the present invention include the debilitating spray dispensing system comprising at least one nozzle and a dispensing switch disposed on the handle. Some embodiments of the present invention include a handle comprising an ergonomic grip and a guard.

21 Claims, 6 Drawing Sheets

MULTIFUNCTION SECURITY DEVICE

FIELD OF THE INVENTION

The present invention is directed to an apparatus for providing law enforcement and private citizens with a single device that integrates law enforcement tools and mechanisms for the application of force. Specifically, an exemplary device features a metal detector, a light emitting source optionally having a strobe feature, an electric stun system, and a debilitating spray dispensing system.

BACKGROUND OF THE INVENTION

The present invention is directed to an apparatus for providing law enforcement personnel and private citizens with a single device that integrates law enforcement tools and mechanisms for the application of force. For example, the field of law enforcement includes police officers, correctional officers, transportation security administration officers, and any person whose job function may require the lawful application of force upon another person. Also as an example, private citizens include any person who can lawfully possess mechanisms for the application of force.

Law enforcement personnel are faced with a myriad of threats on a daily basis. While some of these threats necessitate the use of lethal force, most situations simply call for a lesser level of force. Private citizens may also encounter threats which may call for the application of a lesser level of force.

Lethal force is force that is likely to cause serious injury or death. Lethal force is typically implemented in the law enforcement field with a firearm. Lesser levels of force include force application means that are not intended to cause death or serious injury and that decrease a person's capacity for physical resistance.

Many current devices that provide force are cumbersome and difficult to carry clandestinely. Many are not easy to access and operate in physical altercations. Almost all allow attackers to easily disarm the user. This problem is exacerbated in the case of private citizens who do not have the level of training a law enforcement officer might have in handling physical confrontational situations. If a device is easily taken away from the intended user, the user is at a significant disadvantage.

Devices that employ one form of force are known. These include electric stun guns, debilitating sprays, strobe lights and blunt objects. Electric stun guns deliver a low current, high voltage electrical charge to a person's body, temporarily immobilizing the charged person. Debilitating sprays, such as pepper spray or tear gas, create a burning sensation on the skin and in the eyes. A strobe light can produce a disorienting light pattern that can be applied to a person or animal. Blunt objects can be used to physically subdue a person.

Many implementations of the above mechanisms are single-purpose devices. A stun gun, debilitating spray canister, strobe light and blunt object are often carried separately, adding unnecessary weight to the user's person and decreasing the user's agility. The need to carry multiple items is also inconvenient and increases the time it takes for a user to gear up. In situations calling for the use of one of the devices, the user must search for the appropriate device, grasp it, and then apply it. These steps must be done quickly so the user maintains control of the situation and does not allow the subject of the force to gain a tactical advantage. These characteristics render users less effective at their job functions.

There are some combinations of these devices that are known. However, these combinations are cumbersome, difficult to operate, and increase user reaction time. Combination devices tend to be too large to carry clandestinely, limiting their user base to those who are uniformed personnel. Combination devices tend to implement each feature in a clumsy design that makes operation more difficult than a single-purpose device. This increases user reaction time and decreases user effectiveness. Combination devices tend to allow for the easy disarming of the user. These devices also do not allow for the quick escalation of force according to the aggressiveness and physical proximity of an attacker.

Law enforcement personnel often use several tools to perform their job functions that are not primarily used as force applicators. These tools include flashlights and metal detectors.

Flashlights make vision easier in low ambient light situations. As law enforcement personnel often function during night hours, a portable source of light is essential to their success. Flashlights may also be used to disorient or confuse. A flashlight with a "strobe" feature allows the user to emit alternating beams of high and low intensity light which tend to enhance the disorienting or confusing effects. Metal detectors are used frequently by law enforcement personnel to assess the threat level a subject may pose. Metal detectors are routinely used to screen air travel passengers, suspects, and prison inmates for weapons. When a weapon is found, a tense situation may develop between the user and the subject. If the subject resists the user's efforts, the user needs to quickly employ escalating levels of force to neutralize the situation. Many current metal detectors are not designed for this purpose, giving the user little time to select another tool and deploy it.

Despite earlier attempts, there remains a need in the field for a combination device that seamlessly integrates force application mechanisms and other security tools. There also remains a need for a combination device that is difficult to remove from the user's possession. Furthermore, there remains a need for a combination device that enables the user to quickly and easily escalate the level of force applied in accordance with the physical aggressiveness and proximity of an attacker.

These and other objects of the present invention will be described in the detailed description that follows.

SUMMARY OF THE INVENTION

The present invention is directed to an apparatus for providing law enforcement personnel and private citizens with a single device that integrates law enforcement tools and mechanisms for the application of force.

The present invention allows for the application of force at varying user-to-subject distances. Some aspects of the present invention can operate at effective distances of less than one hundred fifty (150) meters. Other aspects of the present invention can operate at effective distances of less than twenty (20) meters. Still other aspects of the present invention can operate at an effective distance zero (0) meters. The wide range of effective distances provided by the present invention lessens the need for a user to carry additional force applicators. This reduces the expense of additional items in terms of equipment cost, lost agility, and increased training requirements.

The present invention allows for the rapid selection of the force level applied. The rapid selection of force feature is beneficial in situations where the distance between user and subject decreases and where the subject produces or threatens to produce a force applicator of his/her own. As threat levels may rise and fall rapidly, it is imperative that a prepared user can meet the threat equally as fast. Ease of use also plays a role in the speed at which a user may select the level of force applied.

The varying user-to-subject distances and rapid selection of the force level combine to allow the user to use devices in accordance with the present invention to conduct a search of the subject at a relatively safe distance. If the subject resists or becomes violent, the user can immediately select the level of force, apply it, and temporarily disable the subject. The temporary disablement of the subject allows the user to take appropriate remedial action.

In one embodiment, the present invention is a multifunction security device comprising a shaft; a light emitting source disposed at the distal terminus of said shaft; an electric stun system disposed within said shaft; a debilitating spray dispensing system housed within said shaft; a handle disposed at the proximal terminus of said shaft; a power source disposed within said shaft, said power source configured to be in electrical communication with at least one of said light emitting source and said electric stun system.

Some embodiments of the present invention include a metal detector disposed within said shaft.

Some embodiments of the present invention include an electric stun system comprising a plurality of probes mounted to a terminus of the shaft and configured to protrude from the shaft, a plurality of plates configured longitudinally along the outer surface of the shaft, and a stun system switch disposed on the shaft.

Some embodiments of the present invention include the debilitating spray dispensing system comprising a nozzle and a dispensing switch disposed on the handle.

Some embodiments of the present invention include a light emitting source configured to have a strobe feature. Some embodiments of the present invention include a handle comprising an ergonomic grip and a guard.

DETAILED DESCRIPTION

Figure 1:
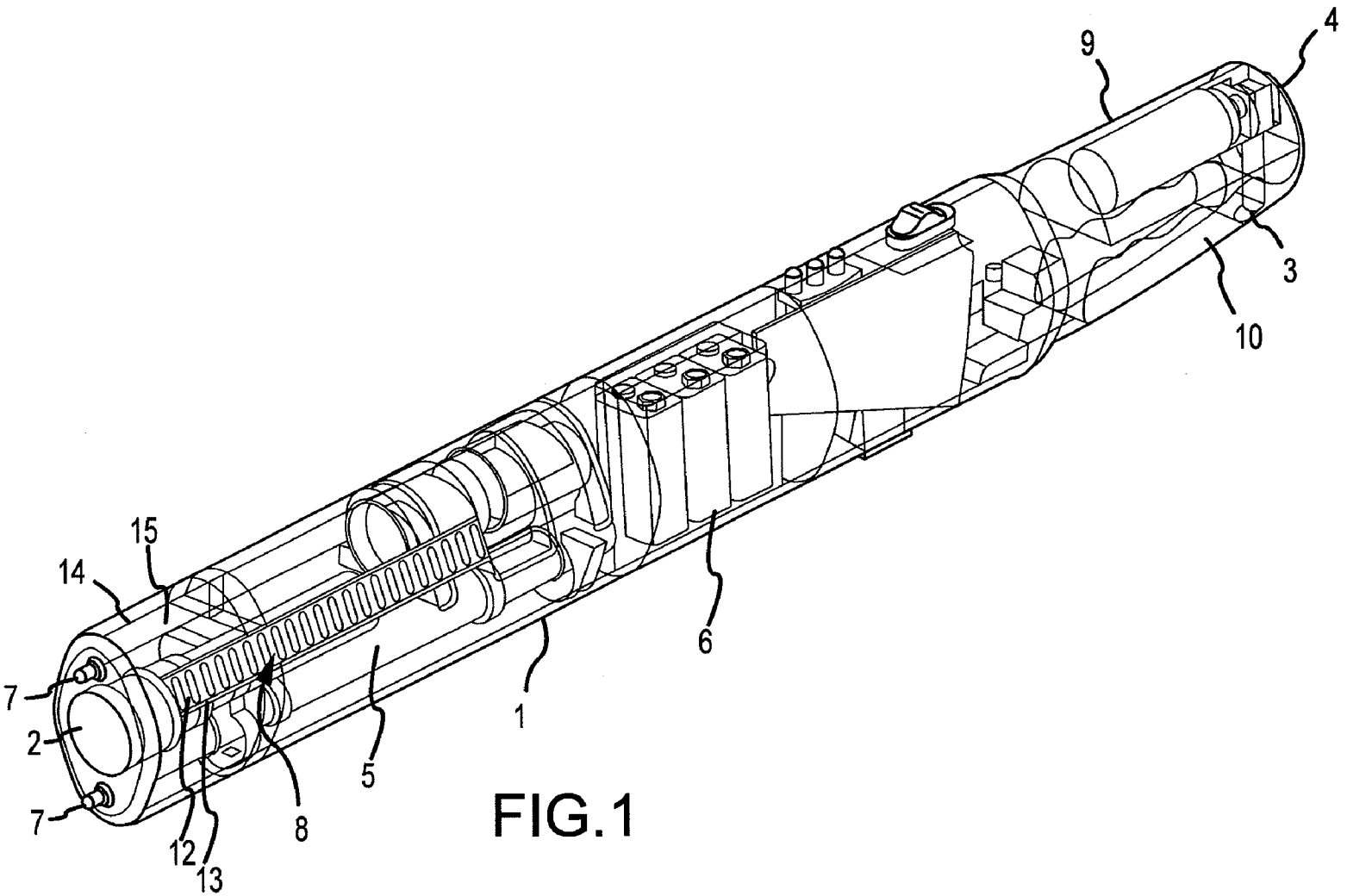
FIG. 1 is a transparent assembly view of an embodiment of the present invention.

The invention is described with reference to the enclosed Figures wherein the same numbers are used where applicable. The term "user" means a person using the multifunction security device. The term "subject" means a person or animal upon which the user is applying the features of the multifunction security device. As used herein, force means force application that is not intended to cause death or serious injury and that decrease the capacity for a person or animal to physically resist the user. As used herein, proximal means the location on the present invention closer to a point where a user would grasp the device while distal means the location on the present invention further from a point where the user would grasp the device. The term threat could mean any situation where the user believes that any level of force may be applied against the user. The term threat level encompasses both the potential gravity of force applied and the probability that the force will be applied. In various embodiments, the invention is intended for multiple purposes and uses. For example, in the law enforcement context, when a police officer stops a suspect and is required to search the suspect for weapons, the police officer typically employs a traditional "pat down" search. In a "pat down" search, the officer physically touches the suspect from the suspect's feet to his head. This routine poses risks to the officer. For example, a traditional search places the officer at a disadvantage because he has to concentrate on looking for a weapon in many places on the suspect's body while the suspect knows of both a weapon's presence and its location. At the same time, the officer must be prepared to defend himself if the suspect tries to control and use the weapon before the officer finds it. Devices in accordance with the present invention allow the officer to increase the distance between himself and the suspect on comparison to the traditional search method. The increased distance allows the officer to immediately react by using the stun device to shock the suspect. The shock provides the officer critical time to do whatever he needs to do subdue the suspect. Devices in accordance with the present invention provide an officer in such a scenario with time he would not have had using traditional methods and devices. In a traditional search, an officer must place his or her hands on many parts of a suspect's person, including private and sensitive areas. An officer armed with a device in accordance with the present invention need not touch a suspect, saving the officer and the suspect the discomfort and embarrassment of a search using traditional methods. This is especially true when the officer and suspect are of opposite sexes.

In various embodiments, devices in accordance with the present invention allow the user to apply force to the subject in several ways. The force applied is intended to lessen the capacity of the subject to resist. With lessened resistance capacity, the user may safely subdue the subject for lawful purposes. The user may tailor the force applied to meet the particular threat level of the situation. The user may select the type of force application quickly. For example, a strobe feature may be used to disorient a subject. If the subject advances despite the strobe feature, a debilitating spray may be quickly deployed at the subject. If the subject continues to threaten the user, an electric stun system may be used to electrically stun the subject. Should the subject attempt to grasp the present invention, the electric stun system will provide another electric stun. The features could be used in any order. In a surprise attack in close quarters, the electric stun system could be used to subdue the subject.

In various embodiments, the present invention includes a rigid housing. The rigid housing allows the user to cause impact between the housing and the subject for the purpose of lessening the subject's capacity to resist. Preferably, the rigid housing has hardness sufficient to resist permanent deformation when impact is made with a subject or with another hard object. The rigid housing also protects interior components from damage done by impact.

In various embodiments, the present invention includes an electric shock system. The electric shock system delivers an electric shock to the subject, thereby disrupting the function of the subject's body and lessening the subject's capacity to resist the user. High voltage, low current electric shocks are suitable for this application as it will only temporarily impair the subject. In various embodiments, the electric shock system may work in conjunction with a conductive spray material dispensed by the debilitating spray dispensing system. In those embodiments, the electric shock system is able to deliver current to a subject via the conductive spray material and may be used to subdue the subject.

In various embodiments, the present invention includes a debilitating spray dispensing system. The debilitating spray dispensing system allows the user to dispense a debilitating spray material. In accordance with various aspects of the present invention, the dispensing spray system allows for user defined directional flow of spray material. The debilitating spray material may cause temporary discomfort to the subject, lessening the subject's ability to resist. The discomfort could be accomplished by creating a burning sensation of the skin and mucus membranes, creating temporary vision loss via excessive tearing of the eyes, or by sedating or otherwise impairing the central nervous system of the subject. The discomfort may be directed at the eyes, nose, throat, mouth, or skin of the subject's body. In other embodiments, the debilitating spray material may cause disruption of the consciousness or sensory perception of the subject, thereby lessening the subject's ability to resist. In various embodiments, the debilitating spray system and stun system may work in combination, for example, by allowing the spray system to be charged such that contact by the spray (be it liquid, gas, gel, etc.) not only debilitates the subject via its characteristics described above, but also allows a shock to be applied at a distance, for example, by closing a circuit with two streams of the spray and applying a current from the device, through the streams and the subject. In such embodiments, the shock is produced by the electric shock system. In such embodiments, the shock may be provided by the same transformer which charge the electric shock system, or alternatively, charged by a separate transformer. Alternatively, if the subject is properly grounded, one spray stream may be used to place the device and the subject in electrical communication. Then, a current may be supplied from the device via the spray stream. Also alternatively, two ion channels may be created in a gas, such as, for example, by application of a laser. In conjunction with the stun system, a current may be applied that completes a circuit with the subject via the ion channels.

In various embodiments, the present invention includes an electromagnetic radiation emitting system. The electromagnetic radiation emitting system allows the user to directionally control a beam of electromagnetic radiation. Electromagnetic radiation in the visible light spectrum may be used to illuminate people or objects in low ambient light conditions. Alternatively, electromagnetic radiation in the ultraviolet spectrum may be used to illuminate objects that fluoresce when exposed to ultraviolet light. In yet another alternative, the electromagnetic radiation emitted is in the microwave spectrum.

In various embodiments, the present invention may include a metal detecting system for detecting the presence of metal. The presence of a metal detector eliminates the need for a user to use his or her hands to search a subject for weapons or contraband. Use of one's hands to search another's person places the searcher in close proximity, and thus at higher risk, than a user of an embodiment of the present invention with this feature. The lower risk to the user is advantageous. For example, a user's left hand can operate the device while the user's right hand is available for other uses. In this example, a user's right hand may be used to restrain a subject or to control a weapon such as a gun. In addition, the device allows a user to search a subject at a safer distance than would be possible without use of the device.

In various embodiments, the present invention includes a system for storing and discharging power. Power is electrical energy that can be stored chemically or mechanically and can be delivered in either direct current or alternating current form.

In various embodiments, the present invention includes a system for selective operation in accordance with user preferences. Selective operation is the ability of the device to disable some of its electronic features in response to input from the user. The selective operation feature prevents the various features of the present invention from being used by unauthorized parties.

Figure 2:
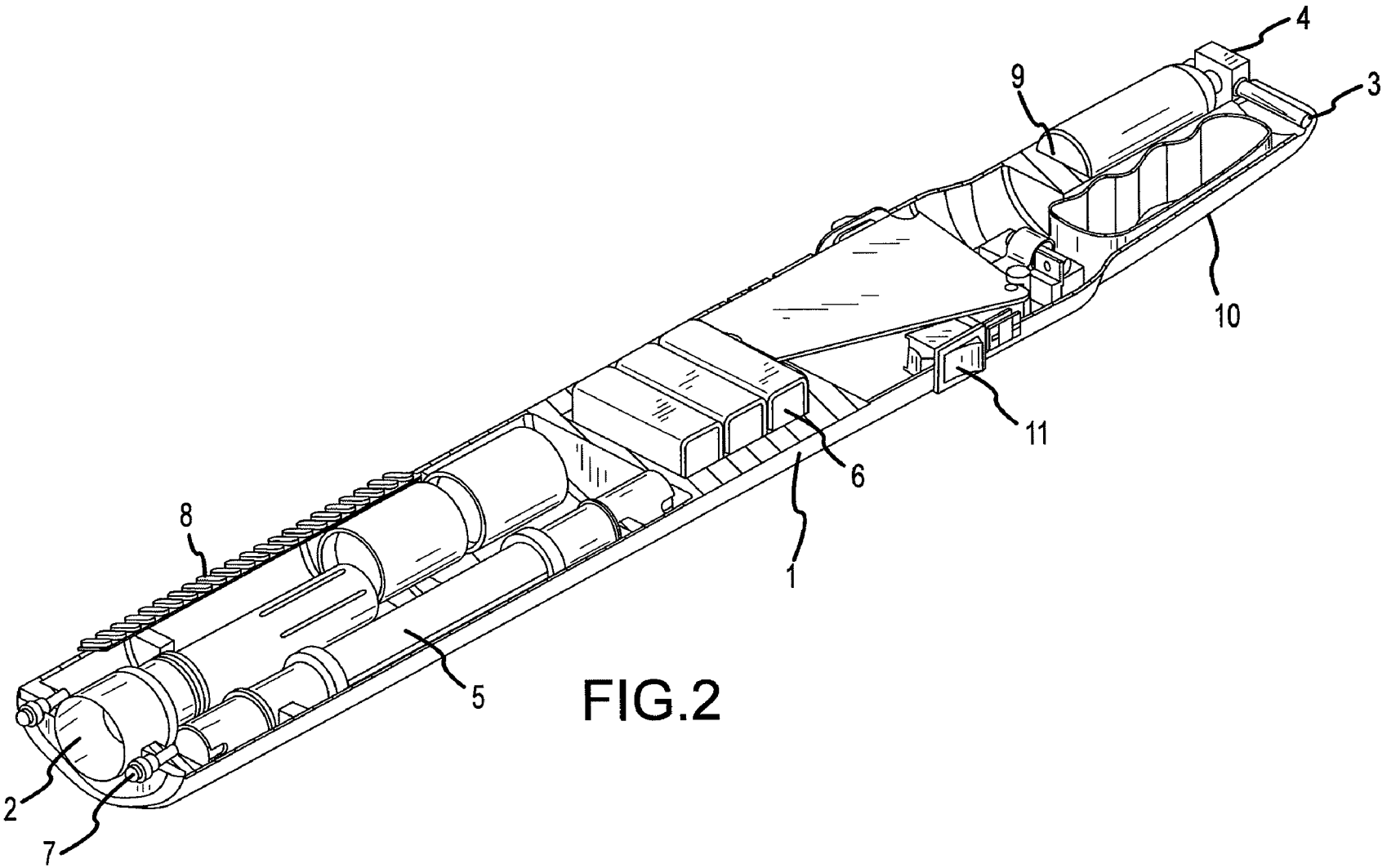
FIG. 2 is a cross-sectional view of an embodiment of the present invention.
Figure 3:
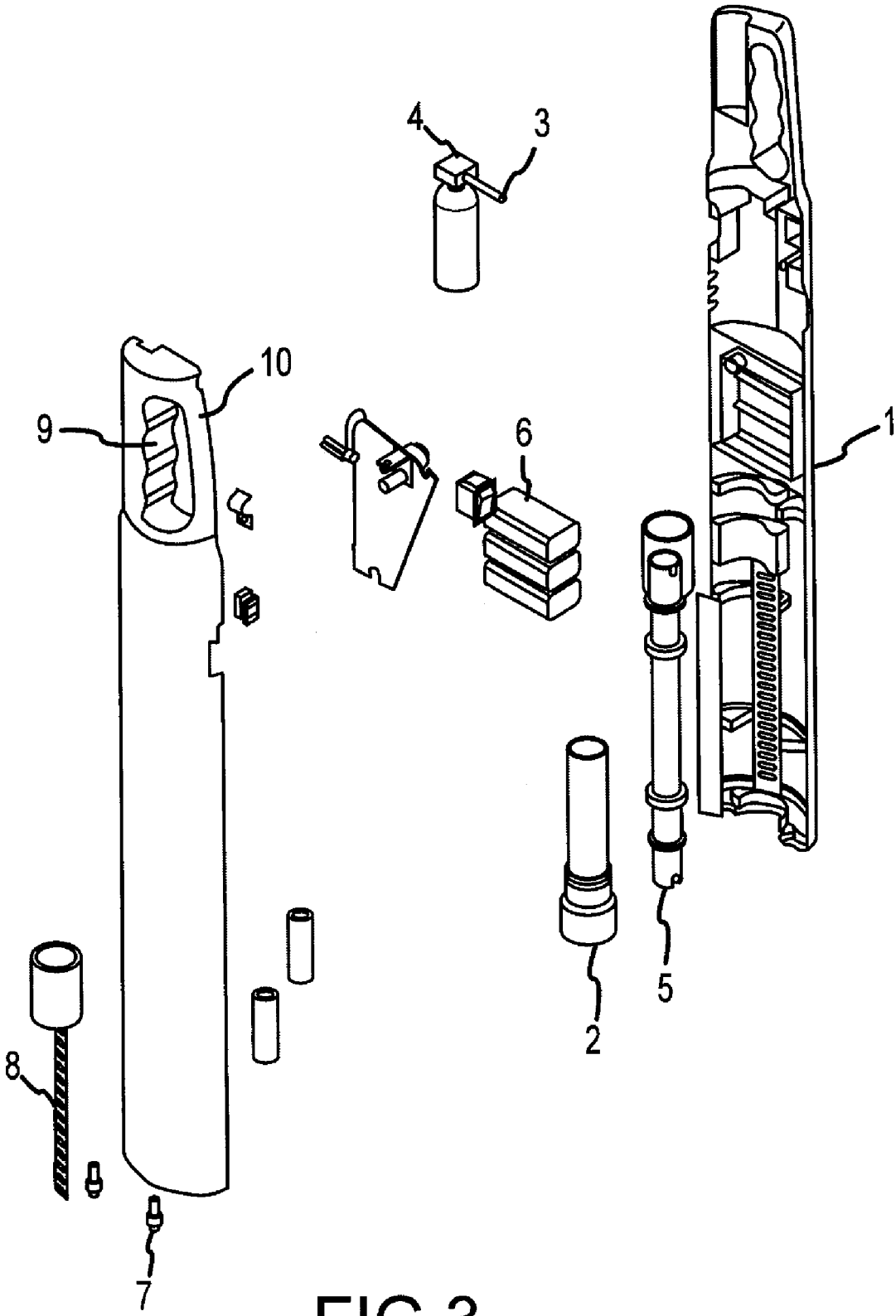
FIG. 3 is an exploded view of an embodiment of the present invention.
Figure 4:
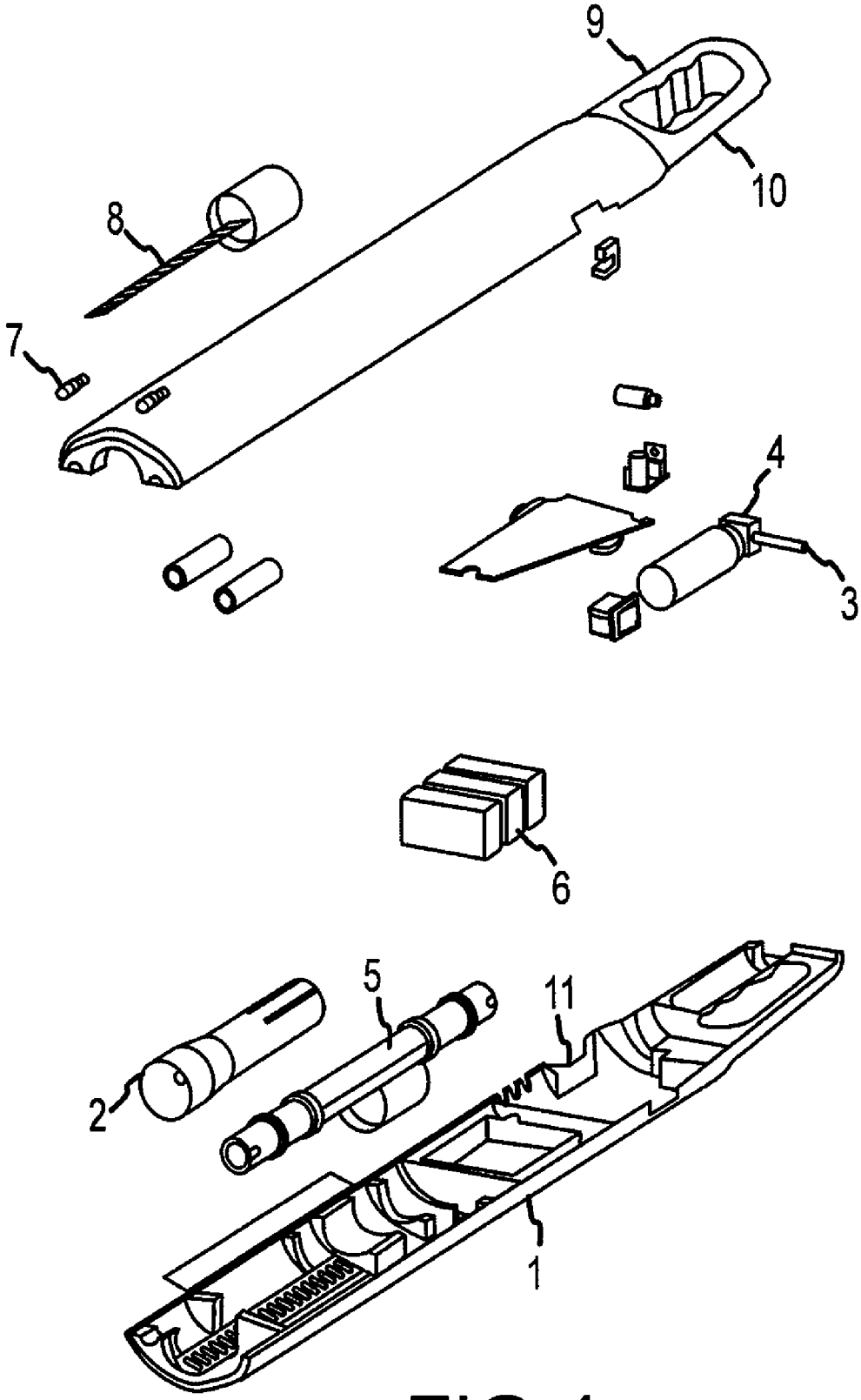
FIG. 4 is an alternate exploded view of an embodiment of the present invention.
Figure 5:
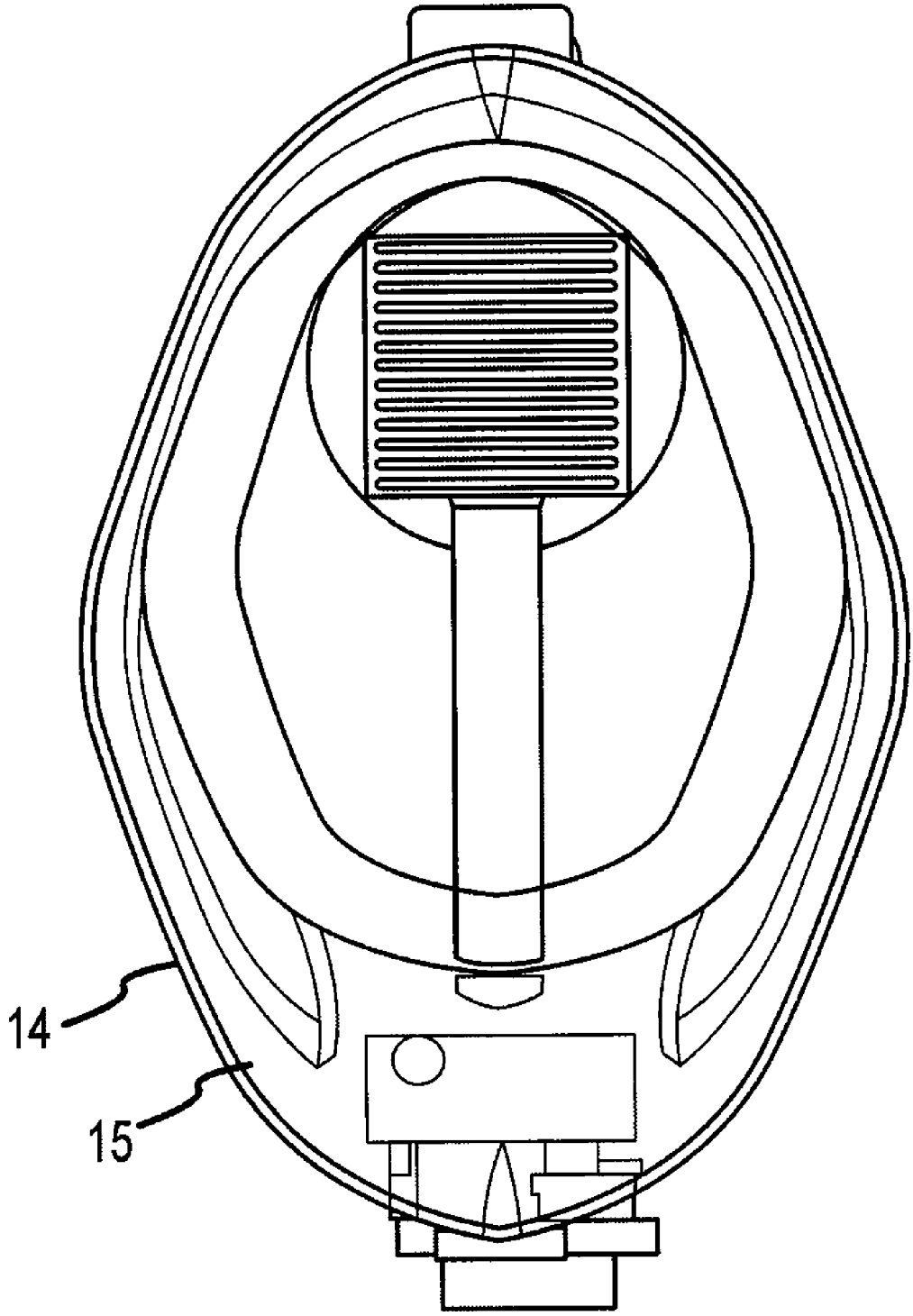
FIG. 5 is a transparent elevation view of an embodiment of the present invention.
Figure 6:
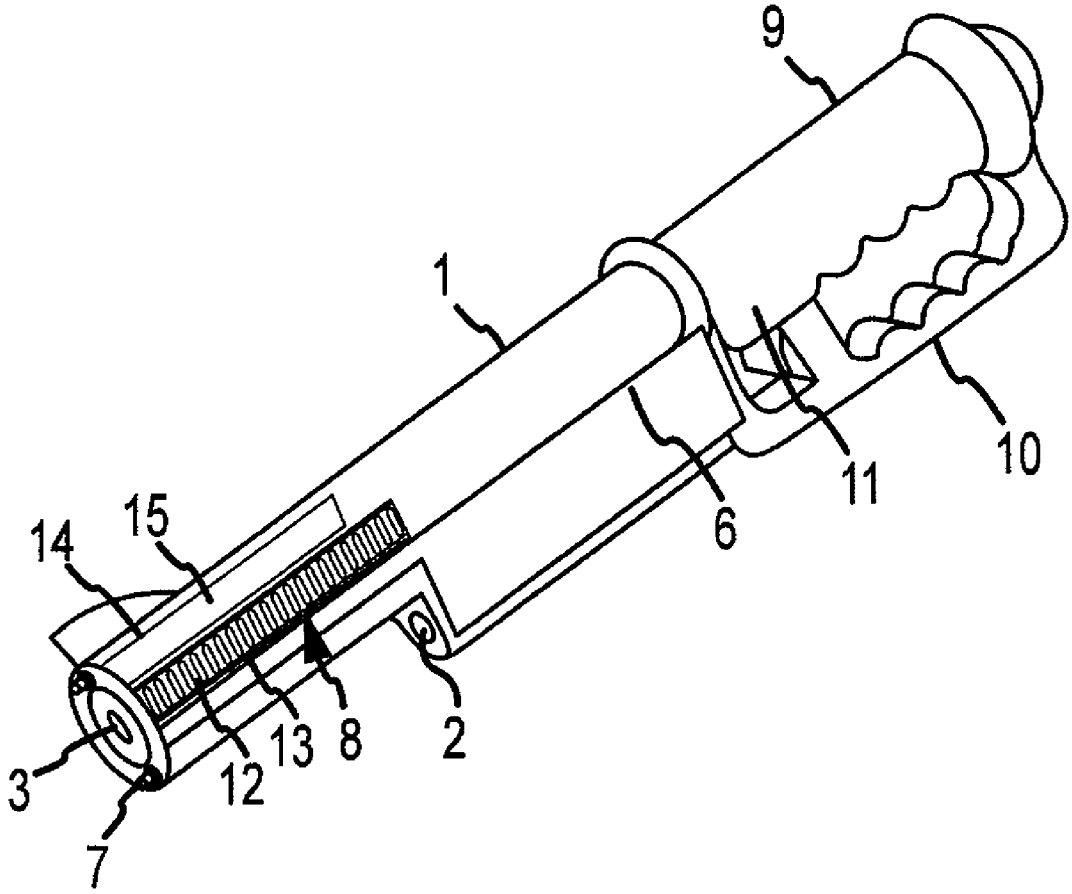
FIG. 6 is an alternate embodiment of the present invention.

Now referring to the exemplary embodiment illustrated in FIGS. 1-6 and referring to Figures herein, the shaft 1 is an elongated housing compartment. In various embodiments, the shaft 1 may range in length from about 1 foot to about 3 feet but one with ordinary skill in the art would recognize that varying lengths would be suitable. The shaft 1 can take the form of any geometric shape such as a cylinder, oval, rectangle, or any combinations thereof. In various embodiments, the shaft 1 may be of irregular shape such that portions of the shaft 1 are of substantially cylindrical geometry and portions are of substantially elliptical geometry. The shaft 1 may be constructed of any durable material. These materials include plastic and metal. The shaft 1 optionally may be used as a blunt force applicator. The shaft 1 may be constructed of plastic or high strength polymer or metal.

The light emitting source 2 is any device capable of generating and emitting visible light or near ultraviolet light of any wavelength. Visible light is typically considered to be electromagnetic radiation of wavelengths from about 400 nm to about 750 nm. Near ultraviolet light is typically considered to be electromagnetic radiation of wavelengths from about 400 nm to about 320 nm. Devices capable of generating and emitting light include incandescent light bulbs, fluorescent light bulbs, light emitting diodes ("LEDs") and lasers. The light emitting source 2 may include a strobe feature where light is emitted in rapid pulses of alternating high and low intensity light. High intensity light is light emitted at a luminous power level such that it will disturb, disrupt, or disorient a human or animal. Low intensity light is light emitted at a luminous power level such that it will not disturb, disrupt, or disorient a human or animal. The alternating pattern of high and low intensity light while in strobe mode will add to the disorienting or disturbing effect upon the subject. The light emitting source 2 is operated via a switch 11. The switch allows the user to turn the light emitting source on and off. The switch may optionally allow the user to turn the strobe feature on and off. The switch may optionally allow the user to activate the electric stun system as described herein. The switch may have multiple positions. In various embodiments, the light emitting source 2 is disposed within the shaft. In other embodiments, the light emitting source is disposed outside the shaft. In an alternate embodiment depicted in FIG. 6, the light emitting source 2 is disposed within the shaft. In the embodiment depicted in FIGS. 1-5, the light emitting source 2 is an incandescent light bulb. In another embodiment, it is an LED. In the embodiment depicted in FIGS. 1-5, the switch 11 has three positions. The first position turns the light emitting source off. The second position turns the light emitting source on. The third position activates the strobe feature.

The electric stun system 7, 8, 11, 12, 13, 14, 15 is any device capable of generating and delivering a high voltage, low current electric shock. High voltage typically means above 29,000V. Low current means current levels most conveniently measured in mA. The electric stun system 7, 8, 11, 12, 13, 14, 15 is intended to deliver an electric shock upon contact of the subject and the present invention. In an exemplary embodiment, the electric stun system may be in contact with the subject for periods of time that are of less than 10 seconds in duration, though other durations may likewise fall within the scope of the present invention depending on the particular application. This electric shock may be delivered in any way suitable for delivery of an electric shock. Electric shocks are generally transmitted by the contact between a conductive material and the skin or clothing of a person or animal. When direct current is used, at least a pair of conductive material components must be used to transmit the shock. The pair of conductive material components consists of a positively charged plate and a negatively charged plate. When the subject's body contacts the at least one pair of conductive material components, a shock is delivered. The electric stun system 7, 8, 11, 12, 13, 14, 15 is activated by a stun system switch 11.

In the various embodiments, two probes 7 extend from the distal terminus of the shaft 1. These probes, when placed against the surface of the subject, carry an electric current to the subject. When using direct current, one probe is a positive terminal and one is a negative terminal.

Also in the embodiment depicted in FIGS. 1-5, the electric stun system comprises a plurality of metal plates 8 that run longitudinally along the shaft. The plurality of metal plates 8 is also capable of delivering an electric current to the subject when put in contact with the subject. The metal plates 12, 13, 14, 15 are arranged in the plurality such that there is a high probability that, when a subject makes contact with the shaft, the subject's body will contact at least one positively charged plate and at least one negatively charged plate. This can be accomplished by arranging the metal plates such that each plate is not adjacent to another plate of the same electrical polarity. Adjacent as used herein means the next closest plate both by measuring from the proximal terminus to the distal terminus of the shaft and by coaxially measuring along the surface of the shaft. An exemplary arrangement of this type is where the positive and negative plates are in alternating sequence when viewing from the proximal terminus of the shaft to the distal terminus. This exemplary arrangement also includes one where plates on opposite sides of the axis of the device are arranged in alternating sequence when viewed from one side of the axis to the other. In one embodiment, the metal plate 12 is a positive terminal and metal plate 13 is a negative terminal. In the same embodiment, metal plate 12 is a positive terminal and metal plate 14 is a negative terminal. This embodiment demonstrates both the proximal/distal relationship between the plates as well as the coaxial relationship. The plurality of metal plates 8 make it difficult for the subject to disarm the user as when the subject attempts to grab the shaft and makes contact with the plates, the subsequent electric shock will dissuade the subject from taking hold of the device. In some embodiments, there is a plurality of metal plates disposed on the guard of the handle as described herein. The plurality of metal plates disposed on the handle is also capable of delivering an electric current to the subject when put in contact with the subject. The plurality of metal plates dissuade the subject from taking hold of the device and provide the user with another offensive option. In the present embodiment, the stun switch is located on the shaft and is incorporated into switch 11. In some embodiments, the stun switch may be implemented via a switch on the handle. In an alternate embodiment depicted in FIG. 6, the switch 11 is implemented on the handle. In various embodiments, the switch on the handle may be of a squeeze type in that the user squeezes the handle to activate the electric shock system.

The debilitating spray dispensing system 3, 4 is any system capable of directionally dispensing a liquid, gel, gaseous spray, or combinations thereof. The system generally requires a nozzle 3 and a dispensing switch 4. The spray itself is intended to be any liquid, gel, gaseous spray or combination thereof that is capable of diminishing the capacity of a human or animal to resist physical force and, optionally, that is capable of depositing an identifying material on a human or animal. The spray could be a lachrymator, a burning agent, a disorienting substance, a dye or any combination thereof. Examples of common debilitating sprays include pepper (capsaicin) spray and various forms of tear gas. A dye material may be one that deposits a visible color to the body of a human or animal. A dye may also be a material that fluoresces upon exposure to ultraviolet light. In various embodiments, devices in accordance with the present invention include two debilitating spray dispensing systems. To use, in the present embodiment, the user activates the dispensing switch 4 which triggers a stream of spray to exit the nozzle 3. In the embodiment depicted in FIGS. 1-5, the switch 4 is located on the shaft near the handle 9. In the present embodiment, the nozzle 3 is located below the handle 9. In other embodiments, the switch is located on at least one of the shaft 1 and the handle 9. In one embodiment, the nozzle is disposed at the distal terminus of the shaft. In embodiments containing two debilitating spray dispensing systems, each system has its own switch. In an alternate embodiment depicted in FIG. 6, the user activates the switch 4, which triggers a stream of spray that exits the nozzle 3 substantially coaxially to the shaft 1.

The handle 9 is any structure suitable for the human hand to grip. The handle may be constructed of any durable material. Durable materials suitable for this purpose include metal, high strength polymer or plastic. The handle may have an ergonomic grip. An ergonomic grip is a grip that is molded to allow a human hand to grasp the handle comfortably and securely. The handle 9 may optionally contain a hand guard 10 to protect the user's hand from attack. The user may use the guard 10 for striking techniques directed towards the subject. In embodiments where the electric stun system includes a plurality of metal plates disposed on the guard, the guard may be used for offensive or defensive use of the electric stun system against the subject. In some embodiments where the electric stun system includes a plurality of metal plates disposed on the guard, the metal plates are disposed on the outside of the guard. In the embodiment depicted in FIGS. 1-5, the handle 9 is constructed of high strength polymer. Also in the embodiment depicted in FIGS. 1-5, the handle 9 has an ergonomic grip. An alternate embodiment, depicted in FIG. 6, has an ergonomic grip and a guard 10.

The metal detector 5 is any device capable of detecting the presence of metal. The metal detector 5 should be of such sensitivity that a user will only be alerted to the presence of metal when the metal detector 5 is several inches away from the metal. In the present embodiment, the metal detector 5 detects metal that is present within inches of the shaft 1. The metal detector 5 may be disposed within the shaft. In an alternate embodiment depicted in FIG. 6, the metal detector 5 is optional.

The power source 6 is any source capable of generating electricity. The power source includes at least one source of electricity. A source of electricity can be a rechargeable battery or batteries, a disposable battery or batteries, or combinations thereof. The power source 6 is configured to be in electrical communication with at least one of the electric stun system 7,8, the light emitting source 2, and the metal detector 5. It is possible for the power source to comprise a source of electricity for each electric stun system light emitting source, and metal detector. In some embodiments, the power source includes two sources of electricity. In some embodiments, one source of electricity is configured to be in electrical communication with the electrical stun system and metal detector and a second source of electricity is configured to be in electrical communication with the light emitting source. In the embodiment depicted in FIGS. 1-5, the power source 6 is a rechargeable or disposable battery. In various embodiments, the power source 6 is a battery pack that comprises a series of batteries coupled together. In such embodiments, the battery pack may be rechargeable or disposable. In the embodiment depicted in FIGS. 1-5, the power source 6 is situated closer to the proximal terminus of the shaft 1 rather than the distal terminus of the shaft 1. In an alternate embodiment depicted in FIG. 6, the power source may be located substantially equidistant to either terminus of the shaft or closer to the proximal terminus of the shaft.

The system for selective operation in accordance with user preferences, not shown in the present embodiment, is any system that is able to selectively disable the electronic components of the invention according to user input. This feature helps to prevent the unauthorized use of the present invention. For example, the system helps to prevent the present invention from being taken from the user and used against the user. It also prevents children from using the present invention. The system also discourages the theft of the present invention by preventing use in subsequent acts, criminal or otherwise.

The system for selective operation in accordance with user preferences may be implemented via a biometric reader and an electronic controller. A biometric reader is a device that can receive biologically identifying data from the user. An example of a biometric reader is a fingerprint reader. An electronic controller would be a device that could selectively enable/disable the electronic features of the present invention in accordance with the biometric data received from the biometric reader.

To commence use, a user would input biologic data into the biometric reader. If the data matched a predetermined authorized user, the electronic controller would enable the electronic features of the present invention. If an unauthorized user attempted to input data into the biometric reader, the electronic controller would disable the electronic features of the present invention. The system for selective operation in accordance to user preferences may also be implemented via a wireless lock and key. A wireless lock and key system would include a wireless transmitter held by the user and a wireless receiver enclosed in the shaft 1. To use, the user would keep the wireless transmitter on close to his/her body. The wireless receiver would then detect the signal of the wireless transmitter and the wireless lock and key system would enable the electronic features of the present invention. If the wireless transmitter moves away from the wireless receiver, such as would be the case if the user dropped the present invention, the wireless lock and key system would disable electronic features of the present invention.

Finally, as used herein, the terms "comprise", "comprises", "comprising", "having", "including", "includes", or any variation thereof, are intended to reference a non-exclusive inclusion, such that a process, method, article, composition or apparatus that comprises a list of elements does not include only those elements recited, but can also include other elements not expressly listed and equivalents inherently known or obvious to those of reasonable skill in the art. Other combinations and/or modifications of structures, arrangements, applications, proportions, elements, materials, or components used in the practice of the instant invention, in addition to those not specifically recited, can be varied or otherwise particularly adapted to specific environments, manufacturing specifications, design parameters or other operating requirements without departing from the scope of the instant invention and are intended to be included in this disclosure.

Moreover, unless specifically noted, it is the Applicant's intent that the words and phrases in the specification and the claims be given the commonly accepted generic meaning or an ordinary and accustomed meaning used by those of reasonable skill in the applicable arts. In the instance where these meanings differ, the words and phrases in the specification and the claims should be given the broadest possible, generic meaning. If it is intended to limit or narrow these meanings, specific, descriptive adjectives will be used. Absent the use of these specific adjectives, the words and phrases in the specification and the claims should be given the broadest possible meaning. If any other special meaning is intended for any word or phrase, the specification will clearly state and define the special meaning.

I claim:

1. A multifunction security device comprising:

a shaft;

a light emitting source disposed at a distal terminus of said shaft;

a handle disposed at a proximal terminus of said shaft;

an electric stun system disposed within said shaft , wherein said electric stun system further comprises a plurality of probes mounted to said distal terminus of said shaft and configured to protrude from said shaft, a plurality of plates configured longitudinally along an outer surface of said shaft, and a stun system switch disposed on at least one of said shaft and said handle;

a debilitating spray dispensing system housed within said shaft;

and a power source disposed within said shaft, said power source configured to be in electrical communication with at least one of said light emitting source and said electric stun system.

2. The multifunction security device of claim 1 further comprising a metal detector disposed within said shaft.

3. The multifunction security device of claim 1, further comprising a spray wherein said spray is configured to act in combination with said electric stun system.

4. The multifunction security device of claim 2 wherein said electric stun system further comprises a plurality of probes mounted to said distal terminus of said shaft and configured to protrude from said shaft, a plurality of plates configured longitudinally along the outer surface of said shaft, and a stun system switch disposed on at least one of said shaft and said handle.

5. The multifunction security device of claim 1 wherein said debilitating spray dispensing system further comprises a nozzle and a dispensing switch disposed on at least one of said shaft and said handle.

6. The multifunction security device of claim 2 wherein said debilitating spray dispensing system further comprises a nozzle and a dispensing switch disposed on at least one of said shaft and said handle.

7. The multifunction security device of claim 1 further comprising a second debilitating spray dispensing system;

wherein said first debilitating spray dispensing system further comprises a nozzle, a dispensing switch disposed on at least one of said shaft and said handle; and;

said second debilitating spray dispensing system further comprises a nozzle, a dispensing switch disposed on at least one of said shaft and said handle.

8. The multifunction security device of claim 2 further comprising a second debilitating spray dispensing system;

wherein said first debilitating spray dispensing system further comprises a nozzle, a dispensing switch disposed on at least one of said shaft and said handle; and;

said second debilitating spray dispensing system further comprises a nozzle, a dispensing switch disposed on at least one of said shaft and said handle.

9. The multifunction security device of claim 1 wherein said light emitting source is configured to have a strobe feature.

10. The multifunction security device of claim 2 wherein said light emitting source is configured to have a strobe feature.

11. The multifunction security device of claim 1 wherein said handle further comprises an ergonomic grip and a guard.

12. The multifunction security device of claim 2 wherein said handle further comprises an ergonomic grip and a guard.

13. The multifunction security device of claim 1 wherein said debilitating spray dispensing system comprises a nozzle configured so as to direct debilitating spray substantially coaxially to the shaft and a dispensing switch disposed on at least one of said shaft and said handle.

14. The multifunction security device of claim 10 wherein said electric stun system further comprises a plurality of plates configured to be parallel with the outer surface of said guard.

15. The multifunction security device of claim 10 wherein said electric stun system further comprises a plurality of plates configured to be parallel with the outer surface of said guard.

16. The multifunction security device of claim 1 wherein said plurality of plates is arranged such that each plate in said plurality of plates is adjacent to another plate of the opposite electrical polarity.

17. The multifunction security device of claim 4 wherein said plurality of plates is arranged such that each plate in said plurality of plates is adjacent to another plate of the opposite electrical polarity.

18. A multifunction security device comprising:

a shaft;

a light emitting source disposed at a distal terminus of said shaft;

an electric stun system disposed within said shaft;

at least one debilitating spray dispensing system housed within said shaft;

a handle disposed at a proximal terminus of said shaft;

a power source disposed within said shaft;

wherein said power source is configured to be in electrical communication with at least one of said light emitting source and said electric stun system;

wherein said handle further comprises a guard;

wherein said light emitting source is configured to distally emit light and is configured to have a strobe feature;

wherein electric stun system comprises a plurality of probes mounted to said distal terminus of said shaft and configured to protrude from said distal terminus of said shaft, a plurality of plates configured longitudinally along the outer surface of said shaft, a plurality of plates configured parallel with the outer surface of said guard, and a stun system switch disposed on at least one of said shaft and said handle; and wherein said debilitating spray dispensing system further comprises a nozzle and a dispensing switch disposed on at least one of said shaft and said handle.

19. The multifunction security device of claim 18, further comprising a metal detector.

20. The method of claim 19 wherein the step of using a multifunction security device to apply said desired level of force further comprises at least one of deploying a strobe feature of a light emitting source, spraying a debilitating spray material, and activating an electric stun system.

21. The method of claim 19 wherein the step of recognizing a threat further comprises using a metal detector to detect said threat.

* * * * *